US008154181B1

(12) United States Patent
Lin et al.

(10) Patent No.: US 8,154,181 B1
(45) Date of Patent: Apr. 10, 2012

(54) LIGHT-GUIDE TYPE LIGHT-EMITTING DEVICE

(75) Inventors: Jun-Feng Lin, Hsinchu County (TW); Chung-En Lee, Kaohsiung (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 13/008,199

(22) Filed: Jan. 18, 2011

(30) Foreign Application Priority Data

Dec. 8, 2010 (CN) ..... 2010 1 0578526

(51) Int. Cl.
*H01J 1/02* (2006.01)

(52) U.S. Cl. ..... 313/46; 313/493; 313/634

(58) Field of Classification Search ..... 313/45, 313/46, 493, 634
See application file for complete search history.

(56) References Cited

U.S. PATENT DOCUMENTS

2011/0285268 A1* 11/2011 Pan ..... 313/46
* cited by examiner

*Primary Examiner* — Vip Patel
(74) *Attorney, Agent, or Firm* — Rabin & Berdo, P.C.

(57) ABSTRACT

A light-guide type light-emitting device includes a heat-dissipating unit, a conductive unit, a light-emitting unit and a light-guiding unit. The heat-dissipating unit includes at least one heat-dissipating body. The conductive unit is disposed on a first side of the heat-dissipating body. The light-emitting unit is disposed on a second side of the heat-dissipating body, and the light-emitting unit includes a plurality of light-emitting elements electrically connected to the conductive unit. The light-guiding unit includes at least one light-guiding element disposed on the light-emitting unit for receiving light beams generated by the light-emitting unit, and the light-guiding element has a plurality of micro light-guiding structures formed on the outer surface thereof. Hence, the instant disclosure can not only mate the light-emitting unit with the light-guiding unit to solve glaring problem as a result of using LED, but also provides a wider light-emitting range.

10 Claims, 7 Drawing Sheets

LIGHT-GUIDE TYPE LIGHT-EMITTING DEVICE

BACKGROUND OF THE INVENTION

1. Field of the Invention

The instant disclosure relates to a light-emitting device, and more particularly, to a light-guide type light-emitting device.

2. Description of Related Art

In terms of allowing people to work during night, the invention of lamp has greatly changed the living style of human beings. Traditional lighting devices such as incandescent light bulbs and fluorescent tubes have been generally well-developed and used intensively for indoor illumination.

Moreover, compared to the newly developed light-emitting-diode (LED) lamps, these traditional lamps have the disadvantages of quick attenuation, high power consumption, high heat generation, short working life, high fragility, and being not recyclable. Thus, various high-powered LED lamps are introduced to replace the traditional lighting devices. However, the glare effect of lights generated by the LED lamp is a problem to be solved in using LED.

SUMMARY OF THE INVENTION

One particular aspect of the instant disclosure is to provide a light-guide type light-emitting device.

To achieve the above-mentioned advantages, one embodiment of the instant disclosure provides a light-guide type light-emitting device, comprising: a heat-dissipating unit, a conductive unit, a light-emitting unit and a light-guiding unit. The heat-dissipating unit includes at least one heat-dissipating body. The conductive unit is disposed on a first side of the heat-dissipating body. The light-emitting unit is disposed on a second side of the heat-dissipating body, and the light-emitting unit includes a plurality of light-emitting elements electrically connected to the conductive unit. The light-guiding unit includes at least one light-guiding element disposed on the light-emitting unit for receiving light beams generated by the light-emitting unit, and the light-guiding element has a plurality of micro light-guiding structures formed on the outer surface thereof.

In conclusion, the instant disclosure solves the glaring problem of LED lamps, and also provides a wider light-emitting range.

To further understand the techniques, means and effects the instant disclosure takes for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention that they be used for limiting the instant disclosure.

DETAILED DESCRIPTION OF THE PREFERRED EMBODIMENTS

Referring to FIGS. 1A to 1E, where the first embodiment of the instant disclosure provides a light-guide type light-emitting device Z, comprising: a heat-dissipating unit 1, a conductive unit 2, a light-emitting unit 3 and a light-guiding unit 4.

Figure 1A:
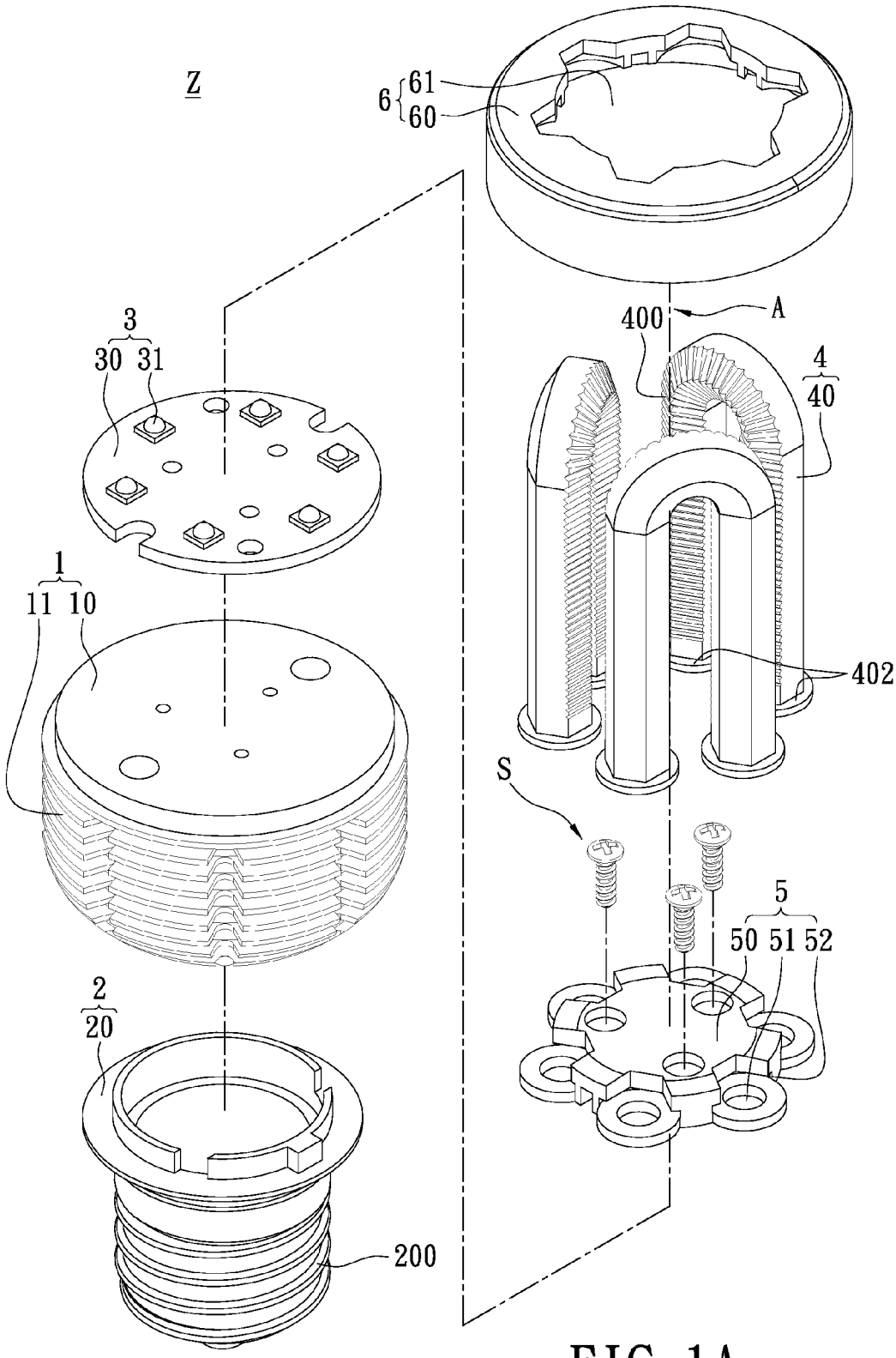
FIG. 1A shows a schematic view of the light-guide type light-emitting device according to a first embodiment of the instant disclosure.

Referring to FIG. 1A, the heat-dissipating unit 1 includes at least one heat-dissipating body 10 and a plurality of heat-dissipating fins 11 mating with the heat-dissipating body 10. For example, the heat-dissipating fins 11 can be integrally formed or extra assembled on the outer peripheral surface of the heat-dissipating body 10. However, the above-mentioned definition of the heat-dissipating unit 1 is merely an example and is not meant to the instant disclosure, thus any structure with heat-dissipating function can be applied to the instant disclosure.

The conductive unit 2 is disposed on a first side (such as a bottom side) of the heat-dissipating body 10. For example, referring to FIG. 1B or 1D, the conductive unit 2 may be an electrical connector 20 having a securing screw 200 formed on the external surface of the electrical connector 20, thus the electrical connector 20 of the light-emitting device Z can be positioned in a power socket (not shown) by rotating to obtain power supply. In addition, the instant disclosure can install a transformer (not shown) inside the heat-dissipating unit 1 or the conductive unit 2 or between the heat-dissipating unit 1 and the conductive unit 2. The transformer is electrically connected between the conductive unit 2 and the light-emitting unit 3 to transform voltage from AC into DC.

Referring to FIG. 1, the light-emitting unit 3 is disposed on a second side (such as a top side) of the heat-dissipating body 10. The light-emitting unit 3 includes a circuit substrate 30 disposed on the second side of the heat-dissipating body 10 and electrically connected to the conductive unit 2 and a plurality of light-emitting elements 31 disposed on and electrically connected to the circuit substrate 30. For example, referring to FIG. 1D, each light-emitting element 31 may be an LED package structure for generating white, yellow or other color light, and the LED package structure includes an LED substrate 310 disposed on and electrically connected to the circuit substrate 30, at least one or more LED chips 311 electrically connected to the LED substrate 310 and a packaging resin 312 covering the at least one or more LED chips 311. In other words, when the user wants the light-emitting device Z to generate white or yellow light, the at least one or more LED chips 311 (such as blue LED chip) can be covered with the packaging resin 312 with wavelength-converting function (such as a phosphor resin formed by mixing phosphor powders with silicon or epoxy). Of course, each LED chip 311 may be a white LED chip, thus the white chip can be covered with the transparent resin to directly generate white light. In addition, each LED chip 311 can also be directly electrically connected to the circuit substrate 30 by a COB (Chip On Board) manner.

Figure 1B:
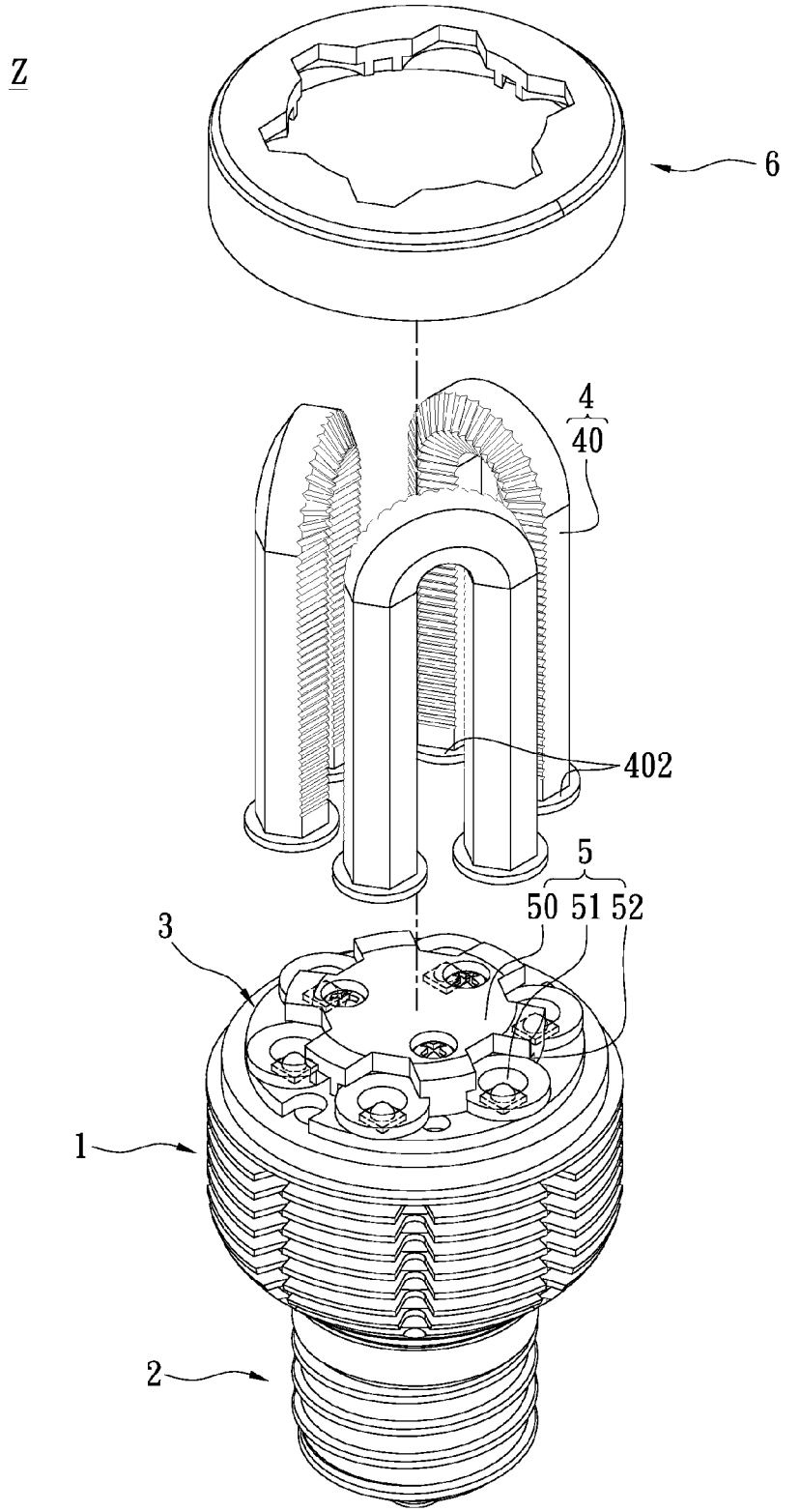
FIG. 1B shows a partial schematic view of the light-guide type light-emitting device according to the first embodiment of the instant disclosure.
Figure 1C:
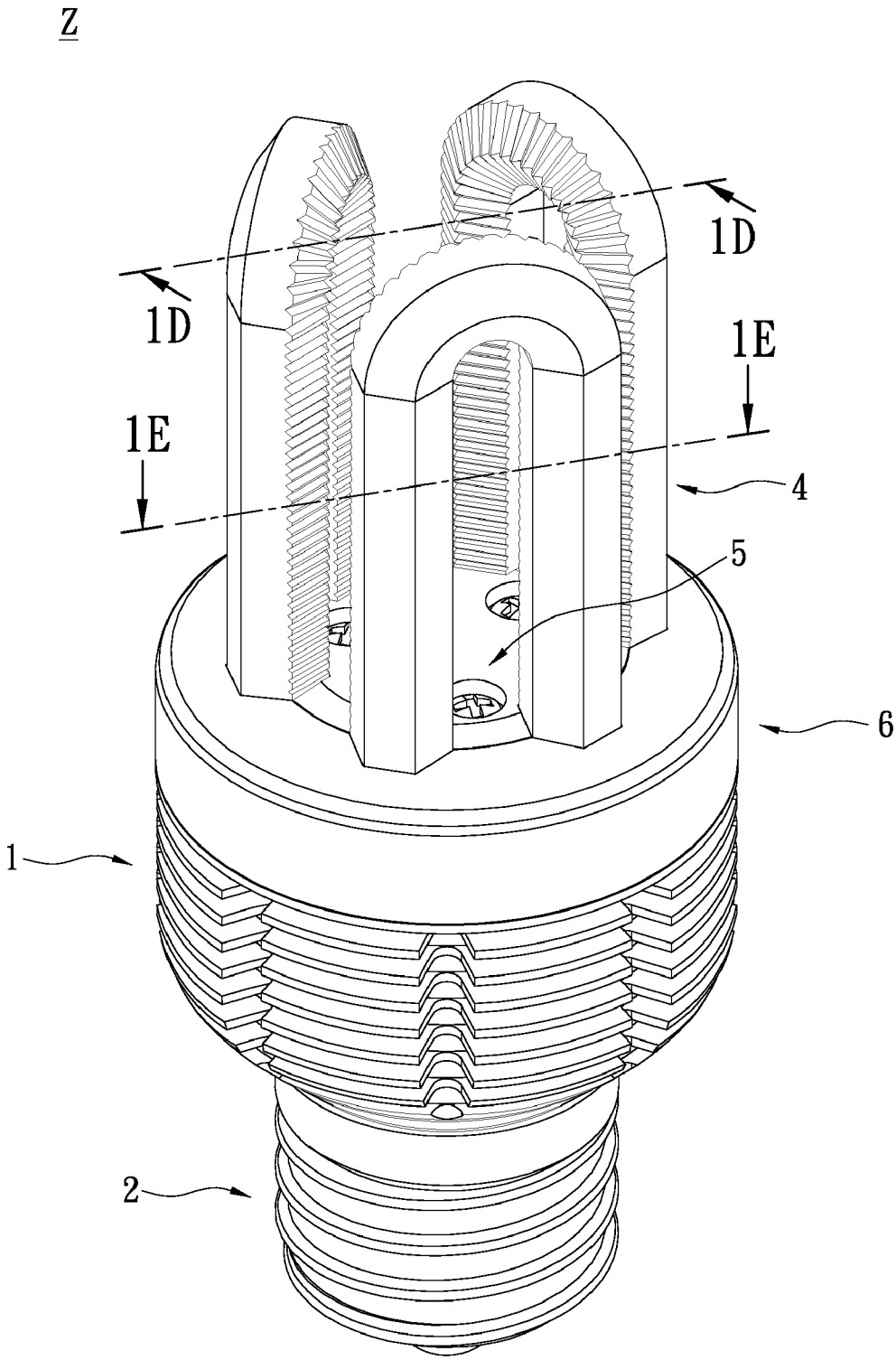
FIG. 1C shows a assembled view of the light-guide type light-emitting device according to the first embodiment of the instant disclosure.
Figure 1D:
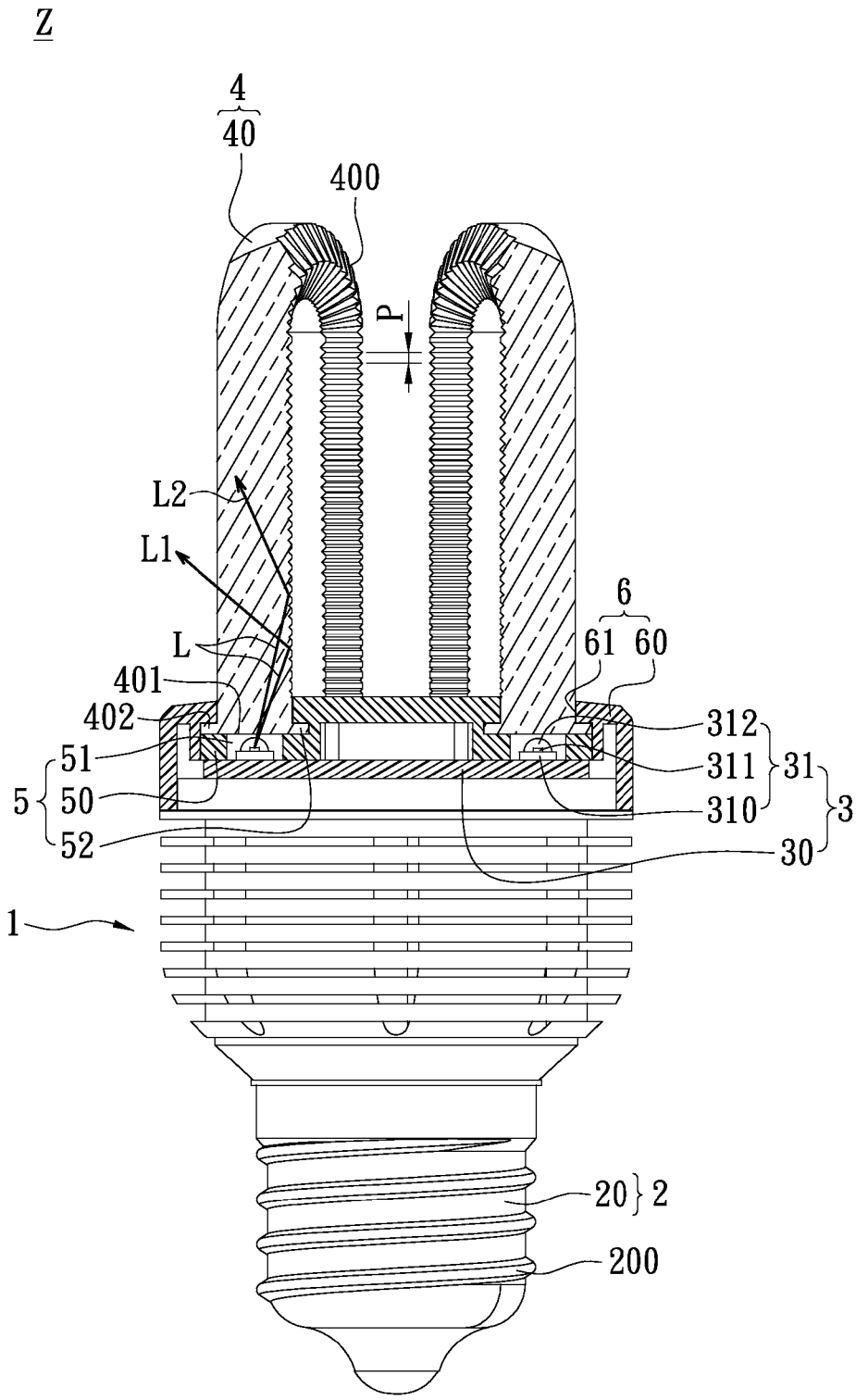
FIG. 1D shows a cross-sectional view taken along the section line 1D-1D of FIG. 1C.

Referring to FIGS. 1A, 1B and 1D, the light-guiding unit 4 includes at least one light-guiding element 40 disposed on the light-emitting unit 3 for receiving light beams L generated by the light-emitting unit 3, and the light-guiding element 40 has a plurality of micro light-guiding structures 400 formed on the outer surface thereof. For example, the light-guiding unit 4 can be composed of more light-guiding elements 40, each light-guiding element 40 may be a U-shaped solid light-guiding bar, and each light-guiding element 40 has two ends 401 respectively facing two planes or two any surfaces of every two light-emitting elements 31. In other words, the two ends 401 of each light-guiding element 40 are two light-entering surfaces, and the two light-entering surfaces of each light-guiding element 40 respectively face every two light-emitting elements 31, thus light beams L generated by the light-emitting elements 31 can be directly projected into the light-guiding elements 40 to reduce lateral stray light. When the light beams L have been projected into each light-guiding element 40, the light beams L can be reflected by the micro light-guiding structures 400 to form a first reflected light beams L1 projected outwards from each light-guiding element 40 or to form a second reflected light beams L2 continuously and forwardly guided inside each light-guiding element 40, thus the light-guiding unit 4 can display a 360° annular light-emitting zone such as a traditional light bulb.

Figure 1E:
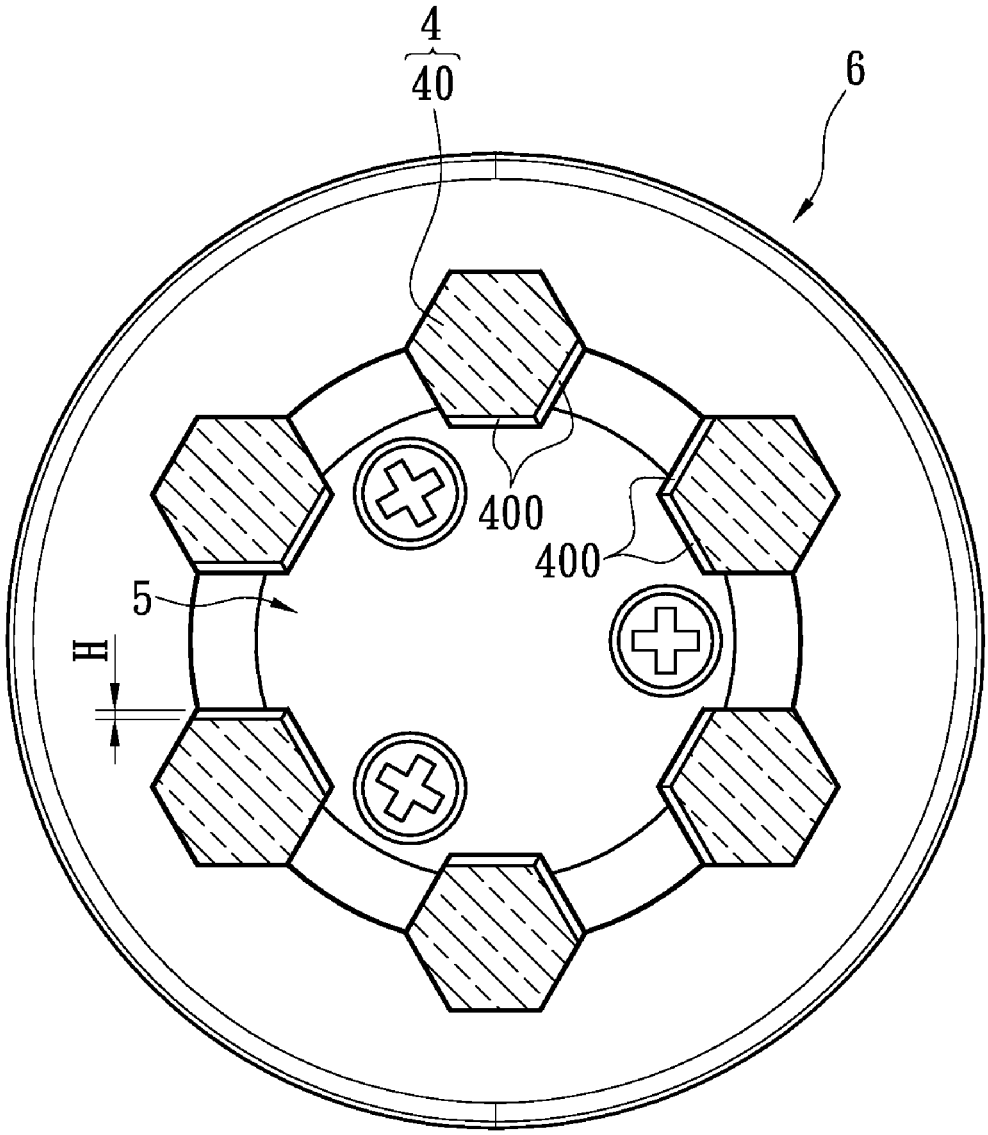
FIG. 1E shows a cross-sectional view taken along the section line 1E-1E of FIG. 1C.

In addition, each micro light-guiding structure 400 may be a convex body (such as arc shape, cylindrical shape, prism shape, etc.) or a concave groove (such as arc shape, cylindrical shape, prism shape, etc.). The ratio of the height H (as shown in FIG. 1E) of each micro light-guiding structure 400 to the interval P (as shown in FIG. 1D) between every two micro light-guiding structures 400 may be 1:0.05~0.6. In other words, when the design of the height H is 1 mm, the design of the interval P can be between 0.05 mm and 0.6 mm, and the interval P between 0.2 mm and 0.5 mm is perfect for the instant disclosure. In addition, each micro light-guiding structure 400 may be a hexagonal column having a hexagonal cross-section, thus one part of the micro light-guiding structures 400 of any light-guiding element 40 can face one part of the micro light-guiding structures 400 of any neighboring light-guiding element 40, and the other part of the micro light-guiding structures 400 of each light-guiding element 40 can face the axle A as shown in FIG. 1A.

However, the above-mentioned definition of the cross-section shape of each light-guiding element 40 or the position of the micro light-guiding structures 400 is merely an example and is not meant to the instant disclosure, thus the light-guiding element 40 with any cross-section shape (such as polygon, circle, wedge etc.) and the micro light-guiding structures 400 on any position of the light-guiding element 40 can be applied to the instant disclosure.

Referring to FIGS. 1A, 1B and 1D, the light-guide type light-emitting device Z further comprises a positioning unit 5 including a positioning body 50 disposed on the light-emitting unit 3 (for example, the positioning body 50 is fixed on the light-emitting unit 3 through a plurality of screws S), a plurality of through holes 51 passing through the positioning body 50 and respectively corresponding to the light-emitting elements 31, and a plurality of retaining grooves 52 respectively corresponding to the through holes 51. In addition, the light-guiding element 40 includes two retaining portions 402 respectively formed on two ends thereof, and each retaining portion 402 is retained inside each retaining groove 52 for accurately positioning the two ends of the light-guiding element 40 to face the light-emitting elements 31.

Moreover, the light-guide type light-emitting device Z further comprising a cover unit 6 including a cover body 60 mating with the heat-dissipating unit 1 to enclose the light-emitting unit 3 and an opening 61 passing through the cover body 60, and the light-guiding element 40 can pass through the opening 51 of the cover unit 5.

In conclusion, referring to FIGS. 1A to 1C, the heat-dissipating unit 1, the conductive unit 2, the light-emitting unit 3, the light-guiding unit 4, the positioning unit 5 and the cover unit 6 can be sequentially assembled together to form the light-guide type light-emitting device Z. When the light-emitting device Z is electrically connected to the power socket (not shown) to obtain power supply, the light beams L generated by the light-emitting unit 3 can be projected into the light-guiding unit 4 to generate a 360° annular light-emitting function without glare from the light-guiding unit 4.

Figure 2A:
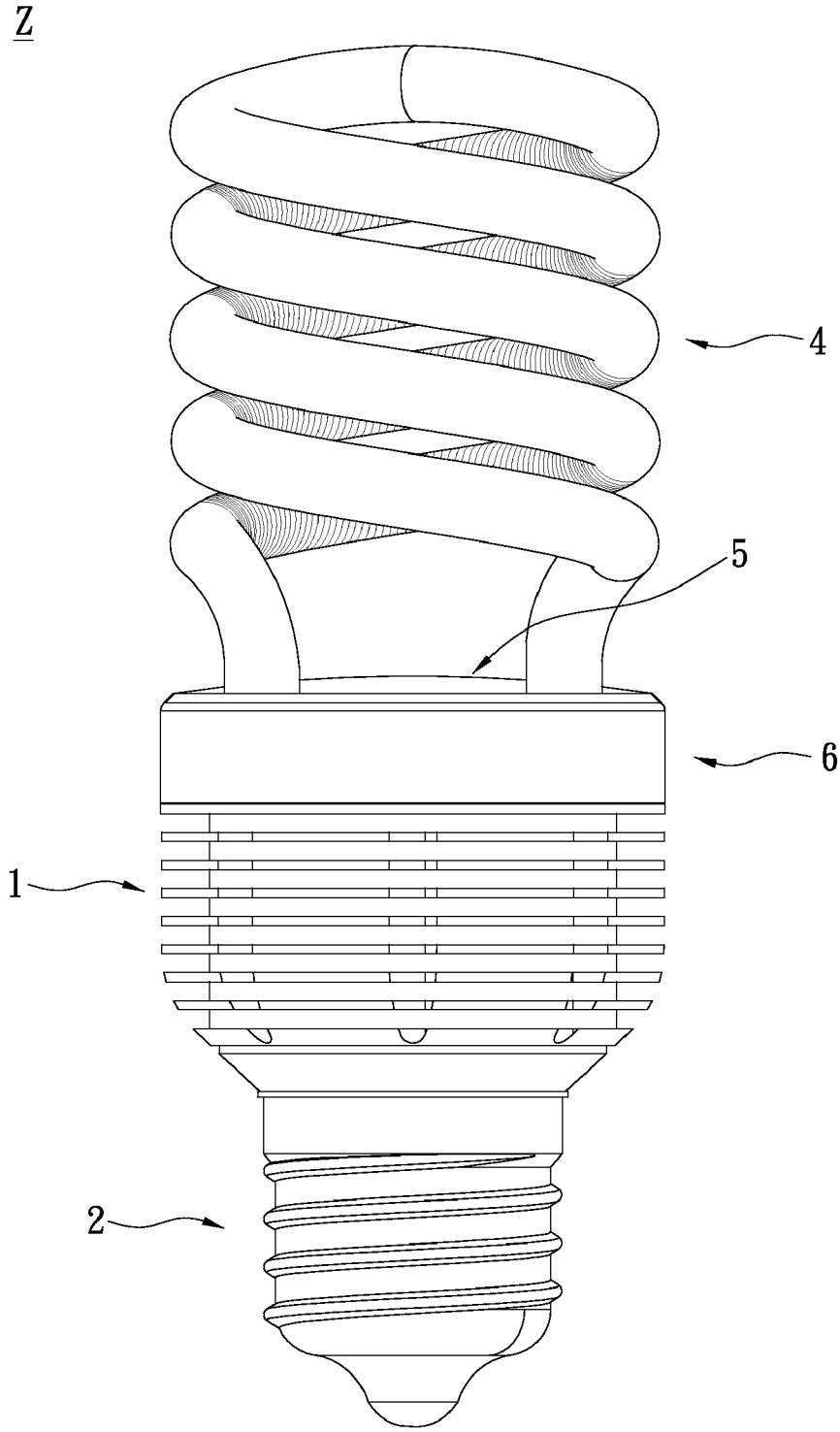
FIG. 2A shows an assembled schematic view of the light-guide type light-emitting device according to a second embodiment of the instant disclosure.
Figure 2B:
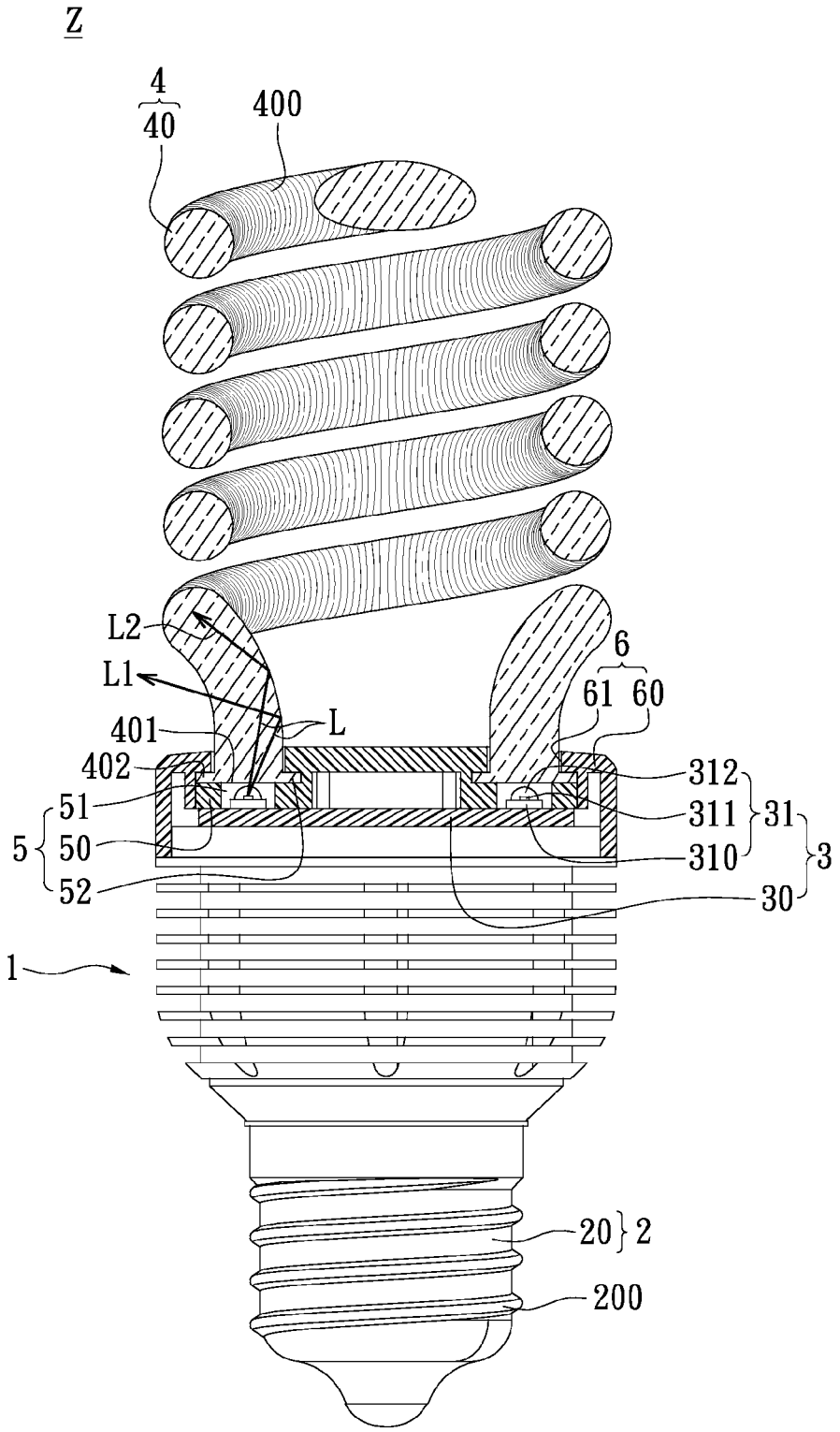
FIG. 2B shows a partial view of the light-guide type light-emitting device according to the second embodiment of the instant disclosure.

Referring to FIGS. 2A and 2B, where the second embodiment of the instant disclosure provides a light-guide type light-emitting device Z, comprising: a heat-dissipating unit 1, a conductive unit 2, a light-emitting unit 3 and a light-guiding unit 4. Of course, the second embodiment can further comprise a positioning unit 5 and a cover unit 6.

Comparing FIG. 2A with FIG. 1A (or FIG. 2B with FIG. 1B), the difference between the second embodiment and the first embodiment is that: in the second embodiment, the light-emitting unit 3 includes at least two light-emitting elements 31 electrically connected to the conductive unit 2, and the light-guiding unit 4 includes at least one light-guiding element 40 disposed on the light-emitting unit 3 for receiving light beams L generated by the light-emitting unit 3. In addition, the light-guiding element 40 may be a dual-spiral solid light-guiding bar, and the light-guiding element 40 has two ends 401 respectively facing the two light-emitting elements 31.

In conclusion, the instant disclosure can not only mate the light-emitting unit with the light-guiding unit to solve glaring problem as a result of using LED, but also provides a wider light-emitting range.

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A light-guide type light-emitting device, comprising:

a heat-dissipating unit including at least one heat-dissipating body;

a conductive unit disposed on a first side of the heat-dissipating body;

a light-emitting unit disposed on a second side of the heat-dissipating body, wherein the light-emitting unit includes a plurality of light-emitting elements electrically connected to the conductive unit; and a light-guiding unit including at least one light-guiding element disposed on the light-emitting unit for receiving light beams generated by the light-emitting unit, wherein the light-guiding element has a plurality of micro light-guiding structures formed on the outer surface thereof.

2. The light-guide type light-emitting device of claim 1, wherein the conductive unit is an electrical connector having a securing screw formed on the external surface of the electrical connector.

3. The light-guide type light-emitting device of claim 1, wherein the light-emitting unit includes a circuit substrate disposed on the second side of the heat-dissipating body and electrically connected to the conductive unit, and the light-emitting elements are disposed on and electrically connected to the circuit substrate.

4. The light-guide type light-emitting device of claim 1, wherein each light-emitting element is an LED package structure for generating white or yellow light, and the LED package structure includes at least one LED chip and a packaging resin covering the LED chip.

5. The light-guide type light-emitting device of claim 1, wherein the light-guiding element is a U-shaped solid light-guiding bar, and the light-guiding element has two ends facing the light-emitting elements.

6. The light-guide type light-emitting device of claim 1, wherein each micro light-guiding structure is a convex body or a concave groove, and the ratio of the height of each micro light-guiding structure to the interval between every two micro light-guiding structures is 1:0.05~0.6.

7. The light-guide type light-emitting device of claim 1, further comprising: a positioning unit including a positioning body disposed on the light-emitting unit, a plurality of through holes passing through the positioning body and respectively corresponding to the light-emitting elements, and a plurality of retaining grooves respectively corresponding to the through holes.

8. The light-guide type light-emitting device of claim 7, wherein the light-guiding element includes two retaining portions respectively formed on two ends thereof, and each retaining portion is retained inside each retaining groove for positioning the two ends of the light-guiding element to face the light-emitting elements.

9. The light-guide type light-emitting device of claim 1, further comprising: a cover unit including a cover body mating with the heat-dissipating unit to enclose the light-emitting unit and an opening passing through the cover body, wherein the light-guiding element passes through the opening of the cover unit.

10. The light-guide type light-emitting device of claim 1, wherein the light-guiding element is a dual-spiral solid light-guiding bar, and the light-guiding element has two ends facing the light-emitting elements.

* * * * *